US006709248B2

(12) United States Patent
Fujioka et al.

(10) Patent No.: US 6,709,248 B2
(45) Date of Patent: Mar. 23, 2004

(54) SCROLL-TYPE FLUID MACHINE HAVING AN OUTER CHAMBER AND AN INNER CHAMBER

(75) Inventors: Tamotsu Fujioka, Yokohama (JP); Ken Yanagisawa, Yokohama (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 10/252,986

(22) Filed: Sep. 23, 2002

(65) Prior Publication Data

US 2003/0059327 A1 Mar. 27, 2003

(30) Foreign Application Priority Data

Sep. 21, 2001 (JP) ..... 2001-290026

(51) Int. Cl.[7] ..... F04C 18/04; F04C 23/00
(52) U.S. Cl. ..... 418/55.2; 418/55.4; 418/59
(58) Field of Search ..... 418/6, 55.1, 55.2, 418/55.4, 59

(56) References Cited

U.S. PATENT DOCUMENTS 4,141,677 A * 2/1979 Weaver et al. ..... 418/59
5,624,247 A * 4/1997 Nakamura ..... 418/55.2
6,290,477 B1 * 9/2001 Gigon ..... 418/55.4

FOREIGN PATENT DOCUMENTS

JP 05-172067 7/1993

* cited by examiner

*Primary Examiner*—John J. Vrablik
(74) *Attorney, Agent, or Firm*—Ostrolenk, Faber, Gerb & Soffen, LLP

(57) ABSTRACT

A scroll-type fluid machine includes a fixed scroll having spiral-form fixed wraps standing on one side face and an orbiting scroll having spiral-form orbiting wraps standing on one side face facing the fixed scroll. The orbiting scroll is set up on a drive shaft so as to be able to orbit. A sealed chamber is formed between the fixed wraps and the orbiting wraps. In the sealed chamber an outer sealed chamber and an inner sealed chamber are defined by an annular partition provided on either the fixed scroll or the orbiting scroll. The outer sealed chamber includes outer inlets on the outside and an outer outlet on the inside, and the inner sealed chamber includes an inner inlet on the outside and an inner outlet in the center. A gas that has been taken in via the outer inlets is compressed and discharged via the outer outlet, and a gas that has been taken in via the inner inlet is compressed and discharged via the inner outlet.

3 Claims, 2 Drawing Sheets

SCROLL-TYPE FLUID MACHINE HAVING AN OUTER CHAMBER AND AN INNER CHAMBER

BACKGROUND OF THE INVENTION

The present invention relates to a scroll-type fluid machine that is usable as a compressor and a vacuum pump, and especially relates to a scroll-type fluid machine that is employed by, for example, a nitrogen concentrator or an oxygen concentrator for medical use.

In order for a gas such as nitrogen or oxygen contained in air to be concentrated at normal temperature, a membrane separation process, a PSA (Pressure Swing Adsorption) process using an adsorbent, or a process using an oxygen adsorbent (CMS; Carbon Molecular Sieve) is generally employed.

In the membrane separation process, air taken in from the atmosphere is pressurized by a compressor and sent to a hollow fiber membrane, and at the same time the hollow fiber membrane is evacuated using a vacuum pump provided on the exit side or part way along the hollow fiber membrane.

When the PSA process using an adsorbent is employed to concentrate oxygen using a nitrogen adsorbent (e.g., a zeolite), air taken in from the atmosphere is pressurized by a compressor and sent to an adsorption column, nitrogen is adsorbed from the air passing through the interior of the adsorption column, and the oxygen-enriched air so obtained is discharged from the exit of the adsorption column. When the adsorption of nitrogen by the interior of the adsorption column decreases, the passage between the upstream side of the adsorption column and the compressor is closed, the downstream side of the adsorption column is connected to a vacuum pump, and the interior of the adsorption column is evacuated by the vacuum pump so as to desorb the adsorbed nitrogen and return it to the atmosphere as an exhaust gas.

Furthermore, when the oxygen adsorbent (CMS) is used for oxygen concentration, air taken in from the atmosphere is pressurized by a compressor and sent to the interior of an adsorption column, and oxygen is adsorbed from the air passing through the interior of the adsorption column. The air from which oxygen has been removed is discharged from the exit of the adsorption column and returned to the atmosphere as an exhaust gas.

When the adsorption of oxygen by the interior of the adsorption column decreases, the passage between the upstream side of the adsorption column and the compressor is closed, the downstream side of the adsorption column is connected to a vacuum pump, and the interior of the adsorption column is evacuated by the vacuum pump so as to desorb the adsorbed oxygen and discharge oxygen-enriched air.

All of the above-mentioned processes require a compressor and a vacuum pump.

In the above-mentioned conventional techniques, since the compressor and the vacuum pump have to be provided separately, there are the problems that a large space is needed for the installation, the implementation in a confined space is difficult, the transport is inconvenient, and the transport cost increases.

SUMMARY OF THE INVENTION

In view of the above-mentioned disadvantages, it is an object of the present invention to provide a scroll-type fluid machine that can serve as both a compressor and a vacuum pump, can be used in a confined space, and is easily transported.

To achieve the object, in accordance with the present invention, there is provided a scroll-type fluid machine comprising:

- a fixed scroll having a spiral-form fixed wrap on one side face;
- an orbiting scroll having a spiral-form orbiting wrap on one side face facing the fixed scroll to form a sealed chamber between the fixed wrap and the orbiting wrap;
- a drive shaft to which the orbiting scroll is connected to be able to revolve eccentrically with respect to the fixed shaft; and
- an annular partition provided on either the fixed scroll or the orbiting scroll to separate the sealed chamber into an outer sealed chamber and an inner sealed chamber, said outer sealed chamber having an outer inlet on the outside and an outer outlet on the inside so that a gas taken in via the outer inlet may be compressed and discharged via the outer outlet, the inner sealed chamber having an inner inlet on the outside and an inner outlet in the inside so that a gas taken in via the inner inlet may be discharged via the inner outlet.

In accordance with the present invention, with a simple arrangement in which the outer sealed chamber and the inner sealed chamber are defined by the annular partition in the sealed chamber formed between the fixed scroll and the orbiting scroll, functions as both a compressor and vacuum pump can be imparted to the scroll-type fluid machine to reduce the size and weight, thereby achieving the cost reduction, enabling its use in a confined space, and making its transport easy.

Moreover, oxygen-enriched air can be obtained by one scroll-type fluid machine driven by a single drive source, without employing a compressor and a vacuum pump, by connecting the outer outlet of the scroll-type fluid machine to the entrance of an adsorption column and the inner inlet of the scroll-type fluid machine to the exit of the adsorption column.

Furthermore, allowing the inner sealed chamber to function as a vacuum pump can suppress any increase in the temperature of the central section of the scroll-type fluid machine, thereby extending the life span of grease and a bearing of an orbiting bearing arranged in the central section.

BRIEF DESCRIPTION OF THE DRAWINGS

The features and advantages of the present invention will become more apparent from the following description with respect to an embodiment as shown in appended drawings, wherein.

DETAILED DESCRIPTION OF THE PREFERRED EMBODIMENT

Figure 1:
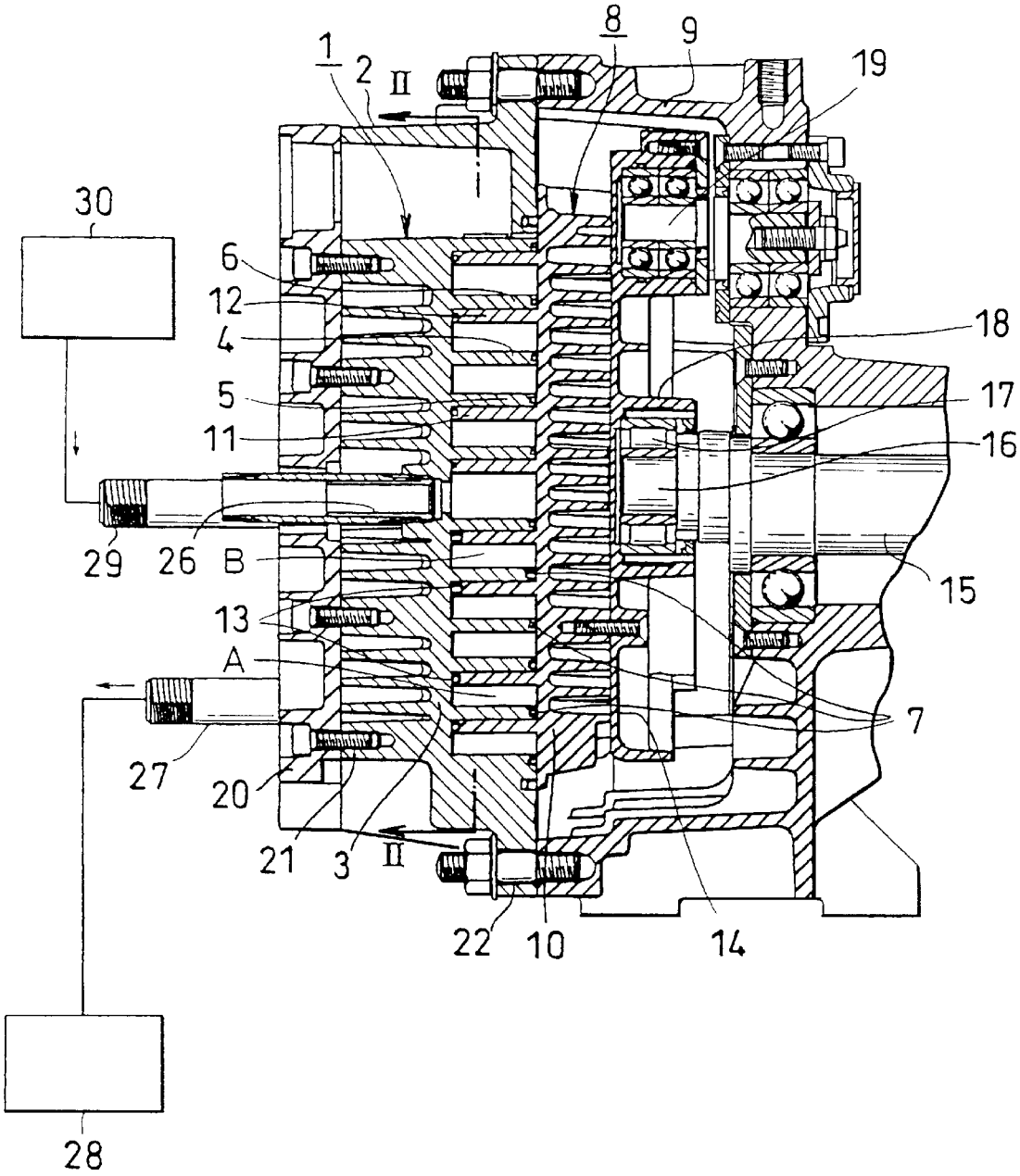
FIG. 1 is a vertical cross-sectional side view of a scroll-type fluid machine.
Figure 2:
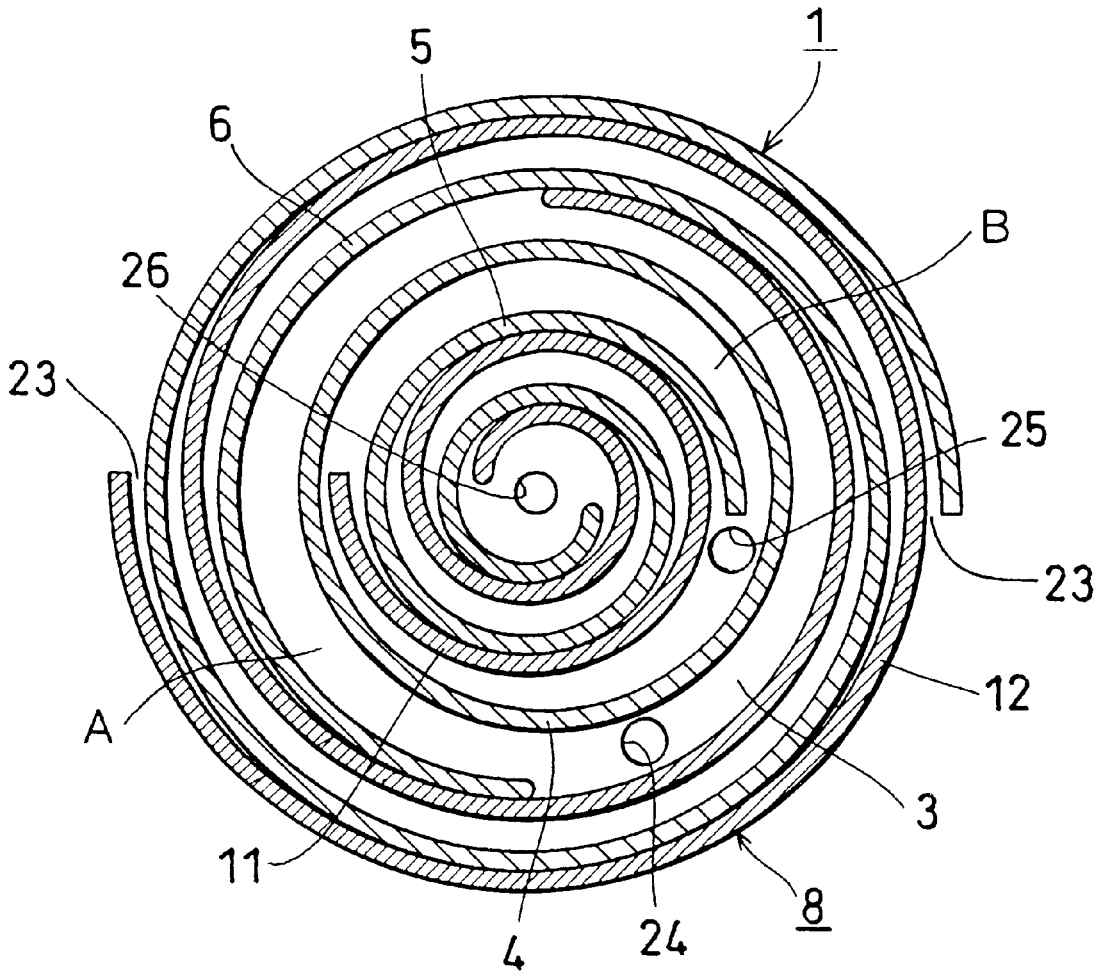
FIG. 2 is a vertical cross-sectional view along line II—II in FIG. 1.

With regard to a fixed scroll 1, provided so as to stand on the front face (to the right in FIG. 1) of a fixed end plate 3 that is integral with a housing 2 are an annular partition 4 having a diameter that is substantially half that of the fixed scroll 1, a spiral-form inner fixed wrap 5 extending outward from the center inside the annular partition 4, and an outer fixed wrap 6 extending outward from a predetermined position outside the annular partition 4. A tip seal 7 is provided on the end face of each of the fixed wraps 5, 6 and the partition 4 so as to be in sliding contact with the front face of an orbiting end plate 10, which will be described later.

An orbiting scroll 8 is arranged so as to face the front of the fixed scroll 1. Provided so as to stand on the front, that is, the side facing the fixed scroll 1, of the circular orbiting end plate 10 provided within a housing 9 are a spiral-form inner orbiting wrap 11 extending outward from the center to a substantially radially central locality and a spiral-form outer orbiting wrap 12 extending, separately from the inner orbiting wrap 11, from a substantially radially central locality to the outermost periphery.

A tip seal 13 is provided on the end face of each of the orbiting wraps 11, 12 so as to be in sliding contact with the front face of the fixed end plate 3.

Provided projectingly on the central part of the rear face of a bearing plate 14 fixed to the rear of the orbiting scroll 8, that is, on the side opposite to that which faces the orbiting wraps 11, 12, is a cylindrical boss 18 pivotably supporting an eccentric shaft 16 of a drive shaft 15 via a bearing 17. Attached to the outer periphery of the bearing plate 14 at appropriate positions are three rotation prevention mechanisms 19 of, for example, a known crankpin type, thereby allowing the orbiting scroll 8 to orbit eccentrically relative to the housing 9.

The fixed scroll 1 and the orbiting scroll 8 are disposed so that the inner orbiting wrap 11 and the outer orbiting wrap 12 of the orbiting scroll 8 mesh with the inner fixed wrap 5 and the outer fixed wrap 6 respectively in a state in which the center of the orbiting scroll 8 is eccentric relative to the center of the fixed scroll 1 and the drive shaft 15 by a distance corresponding to the eccentricity of the eccentric shaft 16.

The sealed chamber formed between the fixed scroll 1 and the orbiting scroll 8 is thus formed so that an outer sealed chamber "A" formed outside the annular partition 4 and an inner sealed chamber "B" formed inside the annular partition 4 are defined by the annular partition 4 so as to block the flow of gas therebetween.

A pressure plate 20 makes contact with the rear face of the fixed scroll 1 and is fastened by means of appropriate fastening screws 21, the front face of the bearing plate 14 makes contact with the rear face of the orbiting scroll 8, and the fixed scroll 1 and the housing 9 are united by, for example, fastening screws 22, thus assembling a scroll-type fluid machine.

The drive shaft 15 is connected to a motor (not shown) provided externally to the housing 9 via, for example, a pulley and a V belt or is directly connected to a rotating shaft of a motor (not shown) provided within the housing 9, and is rotated by the motor in a predetermined direction.

Formed on the outermost periphery of the outer fixed wrap 6 is an outer inlet 23 for taking air into the outer sealed chamber "A".

Provided in the fixed scroll 1 are an outer outlet 24 running axially through the fixed end plate 3 in the vicinity of the outer circumference of the annular partition 4 and communicating with the outer sealed chamber "A", an inner inlet 25 communicating with the inner sealed chamber "B" in the vicinity of the inner circumference of the annular partition 4, and an inner outlet 26 communicating with the inner sealed chamber "B" in substantially the center of the fixed scroll 1.

The outer outlet 24 is connected via a pipe 27 to external equipment 28 that requires a compressed gas. The inner inlet 25 is connected via a pipe 29 to external equipment 30 that requires a vacuum. The air that has been taken in via the pipe 29 from the external equipment 30 and made to flow into the inner sealed chamber "B" is discharged to the outside via the inner outlet 26.

When the orbiting scroll 8 is revolved by a motor, in the outer sealed chamber A the air that has been taken in via the outer inlet 23 is gradually compressed while moving inward in a compression chamber formed between the outer fixed wrap 6 and the outer orbiting wrap, and the compressed air so obtained is finally fed via the outer outlet 24 to the external equipment 28 that requires a compressed gas. That is, the outer sealed chamber "A" functions as a compressor.

Simultaneously therewith, in the inner sealed chamber "B" the air that has been sucked in via the inner inlet 25 from the external equipment 30 that requires vacuum is gradually compressed in a compression chamber formed between the inner fixed wrap 5 and the inner orbiting wrap 11 while moving toward the center, and is discharged to the outside via the inner outlet 26, thereby evacuating the interior of the external equipment 30 to give a vacuum. That is, the inner sealed chamber "B" functions as a vacuum pump.

It should be noted that, although the annular partition 4 is provided on the fixed scroll 1 in the above-mentioned embodiment, the annular partition 4 may be provided on the orbiting scroll 8.

The foregoing merely relates to an embodiment of the invention. Various modifications and changes may be made by a person skilled in the art without departing from the scope of claims wherein:

What is claimed is:

1. A scroll-type fluid machine comprising:

a fixed scroll having a spiral-form fixed wrap on one side face;

an orbiting scroll having a spiral-form orbiting wrap on one side face facing the fixed scroll to form a sealed chamber between the fixed wrap and the orbiting wrap;

a drive shaft to which the orbiting scroll is connected to be able to revolve eccentrically with respect to the fixed shaft; and an annular partition provided on either the fixed scroll or the orbiting scroll to separate the sealed chamber into an outer sealed chamber and an inner sealed chamber, said outer sealed chamber having an outer inlet on an outside and an outer outlet on an inside so that a gas taken in via the outer inlet may be compressed and discharged via the outer outlet, the inner sealed chamber having an inner inlet on an outside and an inner outlet at a center of the inner sealed chamber so that a gas taken in via the inner inlet may be discharged via the inner outlet, said fixed wrap comprising an inner fixed wrap inside the annular partition and an outer fixed wrap outside the annular partition, said orbiting wrap comprising an inner orbiting wrap inside the annular partition and an outer orbiting wrap outside the annular partition so that the inner fixed wrap and the outer fixed wrap may mesh with the inner orbiting wrap and the outer orbiting wrap, respectively, the annular partition being completely separated from all of the fixed and orbiting wraps, the outlet being connected to external equipment that requires a compressed gas, the inner inlet being connected to external equipment that requires a vacuum so that the inner sealed chamber and the outer sealed chamber function as a vacuum pump and as a compressor, respectively.

2. The scroll-type fluid machine as defined in claim 1, further comprising tip seals on the end faces of the fixed and orbiting wraps and the partition, thereby making sliding contact thereof.

3. The scroll-type fluid machine as defined in claim 1, wherein the annular partition is provided on the fixed scroll.

* * * * *